United States Patent [19]

Manzione

[11] Patent Number: 4,850,594

[45] Date of Patent: Jul. 25, 1989

[54] PERFECT PUTTING SURFACES

[76] Inventor: Peter Manzione, P.O. Box 96, Factoryville, Pa. 18419

[21] Appl. No.: 87,638

[22] Filed: Aug. 20, 1987

[51] Int. Cl.[4] ..... A63B 67/02

[52] U.S. Cl. ..... 273/176 R; 273/176 FB; 273/176 J; 273/176 G

[58] Field of Search ..... 273/176 R, 176 A–176 L, 273/273 R, 195 A

[56] References Cited

U.S. PATENT DOCUMENTS 3,735,988 5/1973 Palmer et al. ..... 273/176 J
3,858,887 1/1975 Wallin ..... 273/176 FB

FOREIGN PATENT DOCUMENTS 2338717 8/1977 France ..... 273/176 G

*Primary Examiner*—James C. Yeung
*Attorney, Agent, or Firm*—Richard L. Miller

[57] ABSTRACT

A mat is designed for golf putting practice and may be employed by non-golfers as a party game. Primarily, it consists of a main body of molded non-skid rubber that is irregular in upper surface contour, and a grass carpet is secured to the upper surface contour. A shallow opening is also provided in the structure for the reception of a golf ball, and a main break strip and a plurality of smaller break strips are removably secured to edges of the main body, enabling the mat to be placed in any size room.

2 Claims, 1 Drawing Sheet

PERFECT PUTTING SURFACES

BACKGROUND OF THE INVENTION

The instant invention relates generally to the game of golf, and more particularly to perfect putting surfaces.

Numerous golfing devices have been provided in the prior art that are adapted to simulate putting conditions of a golf course. For example, U.S. Pat. Nos. 4,202,547 of Mueller; 4,203,604 of La Grange; and 4,294,450 of Gallic all are illustrative of such prior art. While these units may be suitable for the particular purpose to which they address, they would not be as suitable for the purpose of the present invention as hereafter described.

SUMMARY OF THE INVENTION

A primary object of the present invention is to provide a perfect putting surfaces that will overcome the shortcomings of the prior art devices.

Another object is to provide perfect putting surfaces which will be so designed, as to fit in a large or small space while accurately simulating putting conditions of a golf course.

An additional object is to provide perfect putting surfaces that will be so designed, as to include artificial grass carpeting with elevated portions and a hole therein, for reception of a golf ball.

A further object is to provide perfect putting surfaces that is simple and easy to use.

A still further object is to provide perfect putting surfaces that is economical in cost to manufacture.

Further objects of the invention will appear as the description proceeds.

To the accomplishment of the above and related objects, this invention may be embodied in the form illustrated in the accompanying drawings, attention being called to the fact, however, that the drawings are illustrative only and that changes may be made in the specific construction illustrated and described within the scope of the appended claims.

BRIEF DESCRIPTION OF THE DRAWING FIGURES

The figures in the drawings are briefly described as follows:

FIG. 1 is a perspective view of the invention showing a golfer standing ready to swing there on;

DETAILED DESCRIPTION OF THE PREFERRED EMBODIMENTS

Figure 1:
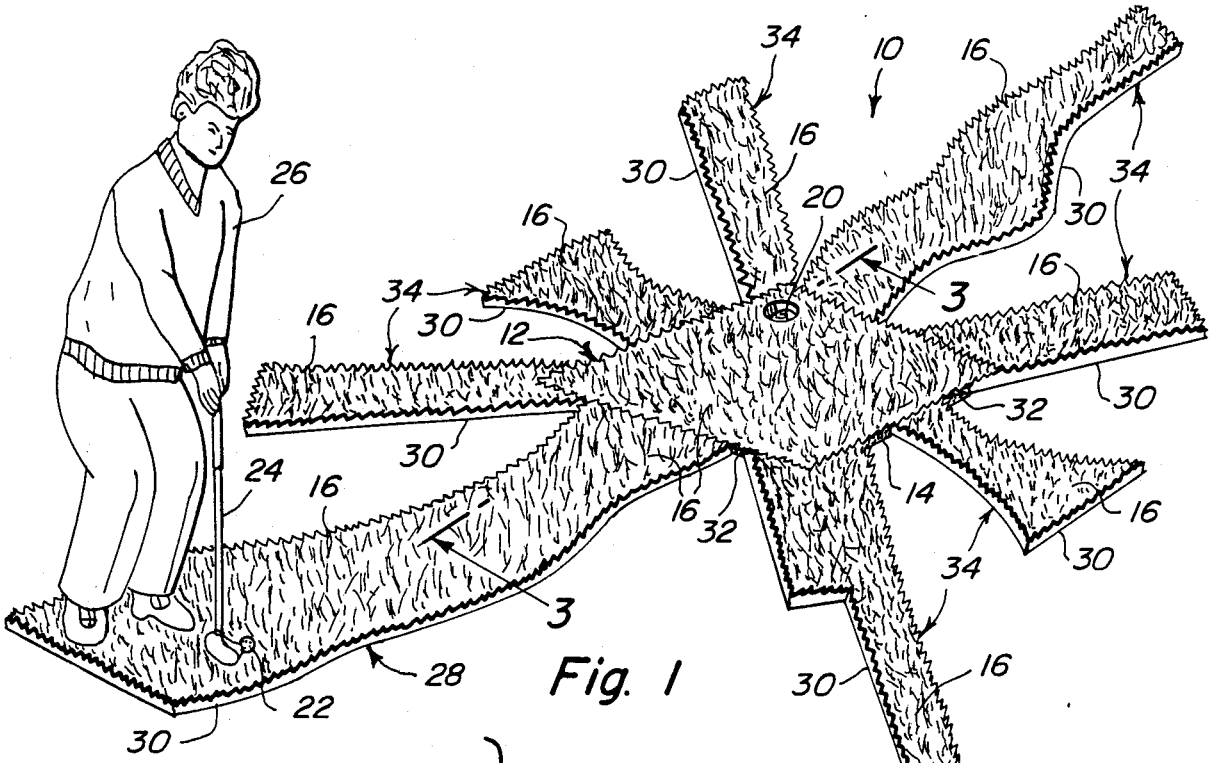
Figure 2:
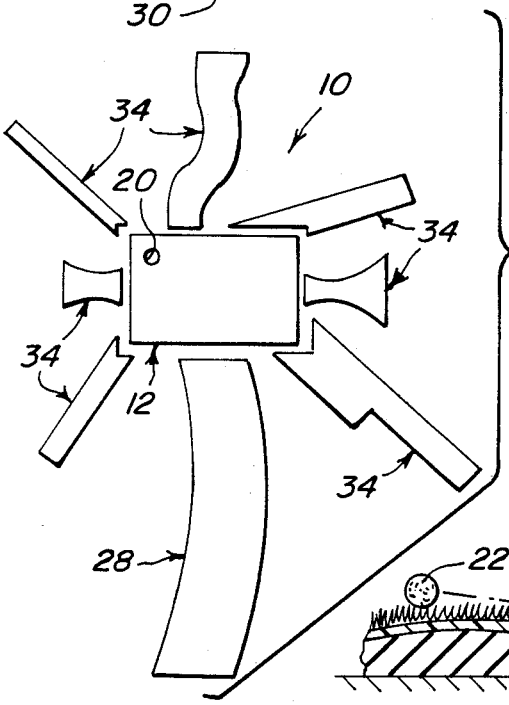
FIG. 2 is a diagrammatic exploded top view thereof.

Turning now descriptively to the drawings, in which like reference characters denote like elements throughout the several views, a putting mat 10 is shown to include a main body 12 of rectangular configuration, having a molded rubber backing 14 fixedly secured an artificial grass carpet 16. Backing 14 is a non-skid type that will not move when placed upon a floor 18, and a cup 20 is provided in the grass carpet 16 and backing 14, for receiving golf ball 22 after being struck by the golf club 24 of a player 26. A main break strip 28 is provided and includes a similar rubber backing 30 fixedly secured to a grass carpet 16, and mating hook and loop fastener strips 32 are fixedly secured to the side edges of main body 12 and an end of break strip 28 together.

A plurality of other break strips 34 are provided and include rubber backing 30 and grass carpet 16, and it is to be noted that the rubber backing 14 and 30, are molded with different contours, so as to enable the ball 22 being putted, to travel uphill, dowhill, sidehill, and break left or right or remain straight, as is found on a standard golf course. The cup 20 is also shallow and similar fastener strips 32 are fixedly secured to ends of break strips 34, for securement to edges of main body 12.

It shall also be recognized, that cup 20 is as shallow as possible, so as to force the player 26 to practice proper distance, stroke and touch, and main break strip 28 and the other break strips 34 may be secured at any edge of main body 12 desired.

In use, the main break strip 28 is fastened to an edge of main body 12 by the fasteners 32, and depending upon the size of the room, some or all of the break strips 34 are similarly attached. When the above has been accomplished, the player positions himself on the outer end portion of main break strip 28 for starting his put shot, and scoring is effected in the same manner as when playing outdoors.

Primarily, putting mat 10 is designed to offer golfers an accurate practice aid and it may also be employed by non-golfers as a party game.

It shall further be noted, that dots may be imprinted on the break strips 28 and 34, enabling a game to be played as a nine or eighteen hole unit.

Figure 4:
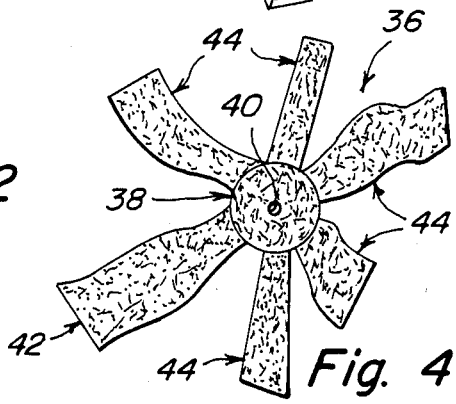
FIG. 4 is a top plan view of a modified form of the invention.
Figure 3:
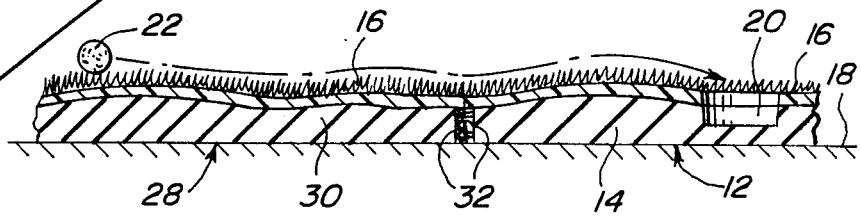
FIG. 3 is a fragmentary cross sectional view taken along line 3—3 in FIG. 1.

Referring now to FIG. 4, a modified form of mat 36 is shown to include a circular main body 38 having a shallow cup 40 and a plurality of break strips 42 and 44, which are radially spaced apart and are attached to main body 38 by hook and loop fasteners (not shown).

Modified mat 36 and the break strips 42 and 44, are of similar structure as that described of mat 10, the exception being that cup 40 is in the center of the structure.

In use, the modified form of mat 36 is employed in the same manner described of mat 10.

While certain novel features of this invention have been shown and described and are pointed out in the annexed claims, it will be understood that various omissions, substitutions and changes in the forms and details of the device illustrated and in its operation can be made by those skilled in the art without departing from the spirit of the invention.

What is claimed is:

1. A putting mat comprising a flexible main body, a cup defined in said main body, for the reception of a golf ball, an elongated, flexible, main break strip having an end removably secured to said main body, for starting a putting stroke with a golf ball, and a plurality of flexible, elongate, smaller break strips having ends removably secured to said main body for further putting, said main body and said smaller break strips each comprising a non-skid rubber backing with an irregular upper surface for simulating undulations of an outdoor golf green, an artificial grass carpet fixedly secured to said irregular upper surface, said cup being in an opening through said grass carpet and partially through said rubber backing, an end edge of said main break strip and side edges of said mat including mating hook and loop type pile fasteners that provide for the removable securing of said main break strip and said smaller break strips to said main body enabling the selective securing of said main break strip and said smaller break strip to said main body forming an integral mat of selected shape, providing an uninterrupted putting surface.

2. A putting mat according to claim 1 in which the main and smaller strips are releasably secured to extend from side edges of the main body aligned diametrically with each other.

* * * * *